United States Patent [19]

Cottrell

[11] Patent Number: 4,775,854

[45] Date of Patent: Oct. 4, 1988

[54] SWIMMING POOL ALARM

[76] Inventor: Samuel F. H. Cottrell, 30061 Red Mountain Dr., Valley Center, Calif. 92082

[21] Appl. No.: 102,013

[22] Filed: Sep. 28, 1987

Related U.S. Application Data

[63] Continuation-in-part of Ser. No. 824,510, Jan. 31, 1986, abandoned.

[51] Int. Cl.[4] ..... G08B 13/00; G08B 21/00

[52] U.S. Cl. ..... 340/566; 200/61.45 R; 200/61.52; 340/573; 340/689

[58] Field of Search ..... 340/566, 573, 689, 690; 200/61.52, 61.45 R

[56] References Cited

U.S. PATENT DOCUMENTS

| | | | |
|---|---|---|---|
| 1,650,968 | 11/1927 | Tedeschi | 340/690 |
| 3,038,151 | 6/1962 | O'Connor, Jr. et al. | 340/566 |
| 3,276,007 | 9/1966 | White | 340/566 |
| 3,769,472 | 10/1973 | Bell et al. | 200/61.45 R |

*Primary Examiner*—Glen R. Swann, III

*Attorney, Agent, or Firm*—John J. Murphey

[57] ABSTRACT

A swimming pool alarm is made in the form of an upright floating inverted frusto-cone wherein the narrow part of the cone rises above the floating base and a perimeter surrounds the base above the water line. A ball is positioned atop the narrow portion on a washer holding a spring biased "off-on" electrical switch in the off position against the spring bias. A battery and audible alarm are wired through the switch so that unauthorized entrance into the pool causes the base to tilt from the wave action produced and the ball falls off the washer allowing the switch to activate the alarm.

9 Claims, 1 Drawing Sheet

SWIMMING POOL ALARM

CROSS-REFERENCE TO RELATED APPLICATION

This is a continuation-in-part to my previously filed application, Ser. No. 06/824,510, titled Swimming Pool Water Wave Actuated Alarm, carrying a filing date of 01/31/86, now abandoned.

BACKGROUND OF THE INVENTION

1. Field of the Invention

This invention pertains to the field of household and personal safety appliances. More particularly, this invention pertains to safety devices used in bodies of water such as swimming pools, to sound an alarm upon the unauthorized entry into the pool by some person or animal.

2. Description of the Prior Art

Backyard swimming pools are popular and are increasing in number throughout the United States. While popular, they present a serious hazard to children and small animals who enter unattended pools. Numerous instances of child drowning have been reported. In virtually all of these cases, the child has entered the pool at times when no adult or other responsible individual attended the pool to see to the child's safety.

Safety precautions such as surrounding the pool with fences have not stopped the continual drowning hazard of the pools. Children climb the fences or find ways of opening the gates. Even flood lights do not seem to have made the pools much safer. Insurance rates for dwellings with outdoor swimming pools are high and appear to be increasing due to the ever-present danger of children entering the pool and drowning.

The prior art has attempted to deal with these swimming pool hazards by utilizing floating alarms that would actuate upon wave action generated by the unauthorized entry of a child or animal into the pool. For instance, in a patent to White, U.S. Pat. No. 3,276,007, a floating plate supports an electric alarm having an actuating switch positioned above a pool of liquid metal such as mercury so that tilting of the base caused by wave action closes the switch and actuates a horn or other audible alarm. In a patent to O'Connor, Jr., et al, U.S. Pat. No. 3,038,151, a hollow, floatable vessel encloses a support having a centered depression wherein a ball is seated. Wave action tilts the vessel and causes the ball to roll out of the depression and fall to a lower surrounding curbing that leads down to a mechanical arm that closes, under weight of the ball, an electric switch to actuate a battery-powered alarm.

While these prior art devices have attempted to solve the problems attendant with swimming pool hazards, they possess certain drawbacks that have prevented them from becoming popular. For instance, in White, slight ripples in the surface of the swimming pool caused by wind may cause the mercury to slosh up and down in the switch and cause the alarm to sound when no one has entered the pool. In addition, one cannot observe the operability of White because the mercury switch, battery and other components are enclosed in an opaque container. Further, the mercury switch is not adjustable so as to be adaptable to swimming pools located in areas of either quiet winds or substantial winds and the constant intermittent sounding of the alarm due to wind rocking will possibly annoy the home owner to the point where he or she removes the device from the swimming pool thereby removing the ability of the alarm to perform its function.

O'Connor, Jr., et al, possesses additional drawbacks: for instance, the interior is substantially complicated so that rain dropping or water splashing into the device could damage one or more of the functional parts thereof. It is also complicated and thus expensive. In addition, observation cannot be made of the position of the ball in the depression so that one must assume that by dropping the ball in through the top opening will position the ball properly. Further, in O'Connor, Jr., et al, the device must be removed from the pool and inverted to re-arm the mechanism for subsequent use and the opaque nature and overlying structure of the device prevents visual observation from the outside as to whether or not the device is really armed.

Accordingly, there is a continuous and on-going need for an inexpensive wave-actuated swimming pool alarm that is visually observable in its armed position, is adjustable to various pool sizes and wave actions due to surrounding winds, is re-armable without removing from the swimming pool and wetting the hands, and that is amenable to having long acting power devices such as solar power compliment its power components.

SUMMARY OF THE INVENTION

This invention is an inexpensive swimming pool alarm that is usable with a wide variety of swimming pools, surface conditions, air currents and weather conditions. It is readily observable in its armed position and can be rearmed without removal from the swimming pool. It is battery operated and has means for utilizing extended power devices such as solar power.

The invention comprises a floating base having an outer perimeter rising above the water line and an inner portion extending from below the perimeter upward and inward therefrom to terminate at a central horizontal portion extending above the perimeter and substantially above the water line. A flat plate or washer having a round aperture or hole therein is set in the top of the central portion. An "off-on" type electrical switch that has a moveable switch arm biased in the "on" position is set in the central portion and arranged with the arm extending upward through the aperture. A round weight, such as a ball, is seated on the aperture in the plate and has a mass sufficient to move and hold the switch arm to the "off" position when atop the central base portion so that the alarm in its armed position is visually observable from afar. A battery or solar-powered energy source is attached through the "off-on" switch to an alarm such as a horn, flashing light or broadcasting antenna. Wave action causes the base to pitch or rock from its upright position thereby moving the flat plate out of horizontal and causing the ball to move or fall off the plate and down to the perimeter. As the ball leaves the aperture the spring biased switch arm moves into the "on" position to energize the alarm. To re-arm the device the operator merely picks the ball up from its position adjacent the rim and places it back on the aperture in the plate. By varying the size of the hole in the plate and the size and weight of the ball, one may adjust the alarm to take into account the various wave actions caused by local weather and surface air conditions and remain armed notwithstanding the slight waves.

Accordingly, the main object of this invention is a low-cost swimming pool alarm actuated by wave action from unauthorized entry into the swimming pool or other body of water whose armed position is readily observable from outside the device. Other objects include a device that is adaptable to various surface conditions, amenable to various wave effects caused by local conditions, is adjustable for said different weather conditions and that will not move in and out of the armed position but will remain armed until being actuated by a wave caused by unauthorized entry into the swimming pool or other body of water. It is contemplated that the device be made mostly of low-cost, lightweight plastic foam that will withstand the rigors of a wide variety of temperature and other climatic conditions. Further, solar power is easily adaptable to this device to allow it to continually charge the batteries so that maintenance is reduced and the life of the device is prolonged. These and other objects of the invention will become more apparent upon reading the following specifications along with the drawings attached hereto. The scope and content of the protection sought by the inventor may be gleaned from a fair reading of the claims that conclude this specification.

DESCRIPTION OF THE PREFERRED EMBODIMENT

Figure 1:
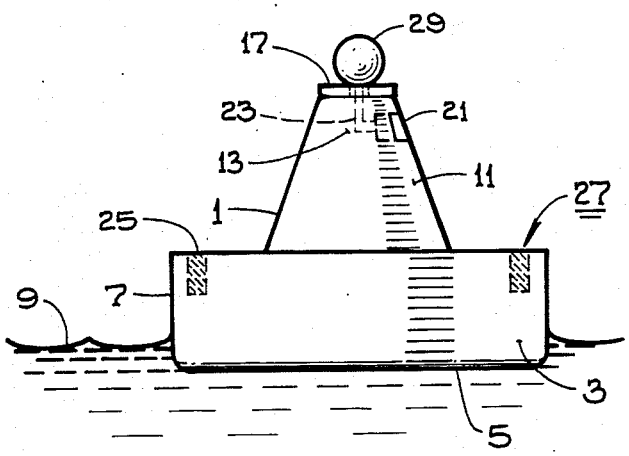
FIG. 1 is a side elevational view of one embodiment of the swimming pool alarm of this invention in its armed configuration.
Figure 2:
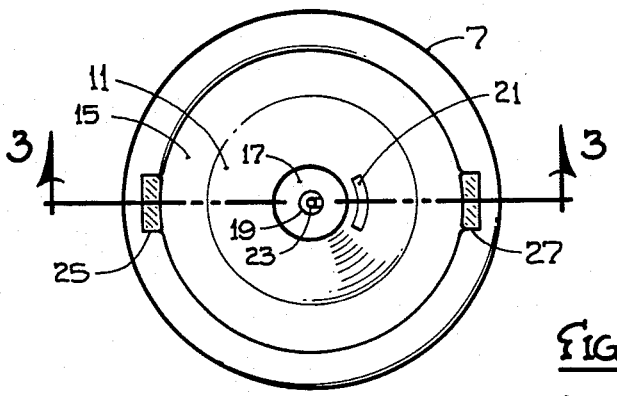
FIG. 2 is a top plan view of the embodiment shown in FIG. 1.

One embodiment of the swimming pool alarm is shown in FIG. 1 generally at 1 and is shown to comprise a base 3 constructed of floatable material such as closed-cell polystyrene foam or other closed-cell plastic foam. Base 3 is defined by a bottom surface 5 terminating in an outer perimeter 7 of varied configuration but preferably circular as shown. The combined weight and configuration of base 3 is such that bottom surface 5 rides below water level 9 and outer perimeter 7 rises above the water line 9. As more clearly shown in FIGS. 2 and 3, base 3 contains an inner portion 11 that extends from below perimeter 7 and inward thereof and upward, terminating at a central portion 13 that is above outer perimeter 7. The preferred embodiment of inner portion 11 is in the form of an inverted frusto-cone wherein central portion 13 becomes a horizontal surface parallel to water level 9 when embodiment 1 is floated in the water. Between outer perimeter 7 and inner portion 11 is a depressed portion 15 extending around base 1 below outer perimeter 7.

A flat plate 17, made of metal or other hard material, is positioned atop central portion 13 and arranged horizontal with water level 9 when embodiment 1 is floating in water. Plate 17 contains a central aperture 19 of preferred circular configuration. An example of a preferred form of plate 17 is a common washer having a circular outer perimeter and circular central aperture.

Figure 3:
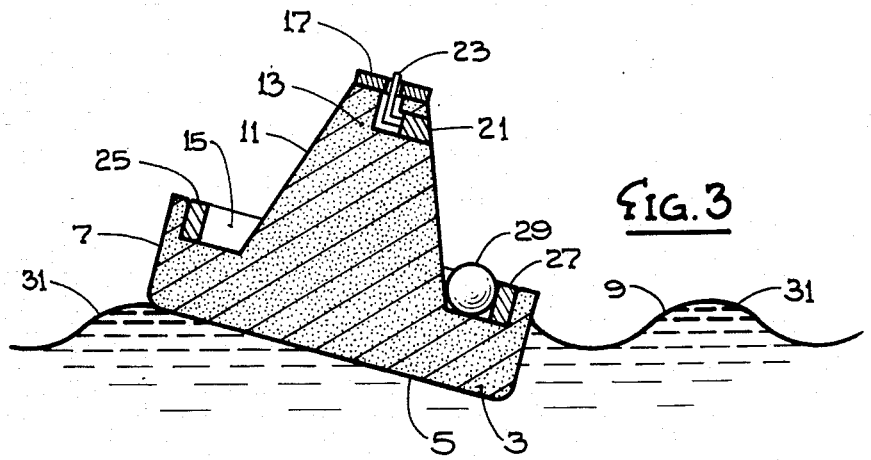
FIG. 3 is a side elevational view of the embodiment shown in FIGS. 1 and 2, taken along lines 3—3 in FIG. 2 and showing the swimming pool alarm after it has been activated due to wave action.

An "off-on" type electrical switch 21 is positioned in central portion 13 below plate 17 and contains a moveable switch arm 23 biased in the "on" position when at rest. It is preferred that switch 21 be a single-throw, single-pole type switch wherein the distance that arm 23 must move between the two positions is relatively short. Switch 21 is positioned in central portion 13 such that switch arm 23 extends upward through central aperture 19 of flat plate 17 as shown in FIG. 3.

An electrically powered alarm 25 and power means 27 are arranged in base 3, preferably in perimeter 7 such that base 3 is balanced and will float upright in the water. Alarm 25 may be of a wide variety of alarms such as an audible horn or whistle, visual blinking lights or a transmitter that broadcasts a signal to trigger remote alarm means or provide interference with television and/or radio reception or otherwise disturbs activities so as to place the home owner on notice that something had entered the pool causing the alarm to be actuated. Power means 27 may be of a variety of batteries or other electric power generating sources and may even include a solar panel for converting sunlight to electrical energy for actuating alarm 25 or for restoring the electrical charge to a battery; all of these possibilities are contemplated in this invention. The electrical wiring from power means 27 to alarm 25 through electric switch 21 is not shown to provide clarity to the drawings however, such wiring is known and recognized in the present state-of-the-art.

A weight 29 having a rounded bottom is positioned in central aperture 19 on to arm the alarm. The mass of weight 29 is chosen sufficient to depress electric switch arm 23, when positioned in central aperture 19, to hold electric switch 21 in the "off" position. As shown in FIG. 3, upon receipt of a series of waves 31 from an intrusion into the swimming pool, base 3 is pitched sideways such that weight 29 is toppled from its position in central aperture 19 and rolls down the surface of inner portion 11 to come to rest in depressed portion 15. Simultaneously, arm 23 of electric switch 21 moves upward, under its bias, to move switch 21 to the "on" position and thereby energize alarm 25 from power means 27 to alert nearby individuals of the intrusion into the swimming pool. Weight 29 is preferred to be a ball of a size and mass that, in conjunction with the size of central aperture 19, will maintain the alarm in an armed condition during periods of normal operation taking into account rippling or surface disturbances created by local winds or other climatic conditions. This invention may be conveniently provided with a series of flat plates or washers 17 and weights or balls 29 of different masses and sizes so as to render the alarm adjustable to various climatic conditions encountered with swimming pools.

One of the salient features of this invention is that in both the "armed" and "un-armed" positions of embodiment 1, it may be observed from a distance, such as from a window or doorway leading to the swimming pool area, thereby assuring the home owner that the invention is ready for use and not incapacitated by virtue of the mechanism being accidentally actuated or by having water, leaves or other debris interfering with the actuation of the alarm.

What is claimed is:

1. A swimming pool alarm, comprising:

a. an upright floating base surrounded by an outer perimeter rising above the water line, and an inner portion extending from below said perimeter upward and inward therefrom terminating at a central portion extending above said perimeter;

b. a flat plate having an aperture therein set horizontally on said central portion;

c. a "off-on" type electrical switch under said plate having an operable arm biased in the "on" position extending upward through said aperture;

d. an alarm and means for energizing same, arranged and balanced in said base to allow said base to float upright in the water and made interconnective for operation through said electrical switch; and, e. a weight having a round bottom, for seating in said aperture, of a mass sufficient to bias said electrical switch in the "off" position when atop said central base portion, and visually observable in said position from afar, so that wave action caused by an entrance into the pool will rock said base and knock said weight off of said plate to cause said switch to energize said alarm.

2. The swimming pool alarm of claim 1 wherein said base is comprised of floatable plastic foam.

3. The swimming pool alarm of claim 1 wherein said plate is a washer having a circular central aperture.

4. The swimming pool alarm of claim 1 wherein said alarm is audible.

5. The swimming pool alarm of claim 1 wherein said means for energizing said alarm comprises a battery.

6. The swimming pool alarm of claim 1 wherein said means for energizing said alarm includes solar energy conversion means.

7. The swimming pool alarm of claim 1 wherein said weight is a spherical ball of a mass and size compared to the size of said central aperture to provide a retention of said alarm in the armed position throughout normally encountered wave action and thereafter to allow said weight to roll off said aperture to actuate said alarm at a preselected level of wave action.

8. A swimming pool alarm comprising:

a. a floating plastic foam base having a circular outer perimeter rising above the water line and a circular inner portion extending from below said perimeter upward and inward therefrom terminating at a flat circular central portion extending above said perimeter to create a depressed portion between said outer perimeter and said central portion;

b. a flat washer having a circular aperture central thereof set horizontally on said central portion;

c. a "off-on" type single-pole, single-throw electrical switch under said plate containing an operable switch arm, biased in the "on" position, extending upward through said central aperture in said washer;

d. an audible alarm and power means therefor arranged in said base to allow said base to float upright during normal operation, said alarm and means interconnected for operation through said electrical switch; and, e. a spherical ball, arranged for seating in said central aperture of said washer, of a size and mass sufficient to depress said switch arm to retain said switch in the "off" position when in the armed configuration.

9. The swimming pool alarm of claim 8 wherein said means for energizing said alarm include solar energy conversion means.

* * * * *